United States Patent [19]

Kawakami

[11] Patent Number: 4,637,452

[45] Date of Patent: Jan. 20, 1987

[54] MOLD APPARATUS FOR CONTINUOUS CASTING SYSTEM

[75] Inventor: Takashi Kawakami, Niihama, Japan

[73] Assignee: Sumitomo Heavy Industries, Ltd., Tokyo, Japan

[21] Appl. No.: 823,560

[22] Filed: Jan. 29, 1986

[30] Foreign Application Priority Data

Sep. 2, 1985 [JP] Japan ..... 60-193424

[51] Int. Cl.[4] ..... B22D 11/04

[52] U.S. Cl. ..... 164/420; 164/436

[58] Field of Search ..... 164/420, 436, 491

[56] References Cited

U.S. PATENT DOCUMENTS

| | | | |
|---|---|---|---|
| 3,478,808 | 11/1969 | Adams | 164/454 |
| 3,717,197 | 2/1973 | Strack et al. | 164/420 |
| 4,532,981 | 8/1985 | Hargassner et al. | 164/420 X |
| 4,546,813 | 10/1985 | Grove et al. | 164/420 |
| 4,562,876 | 1/1986 | Hargassner et al. | 164/420 X |

FOREIGN PATENT DOCUMENTS 59-37703 9/1984 Japan .

*Primary Examiner*—Kuang Y. Lin

*Assistant Examiner*—J. Reed Batten, Jr.

*Attorney, Agent, or Firm*—Armstrong, Nikaido, Marmelstein & Kubovcik

[57] ABSTRACT

A mold apparatus for use in a continuous casting system, has a pair of parallel longer frames disposed to oppose each other and lined at their opposing surfaces, and a pair of shorter frames disposed between opposing ends of the longer frames and lined at their opposing surfaces, the longer and shorter frames in cooperation defining a rectangular mold cavity. A core frame is disposed between the longitudinal centers of the longer frames such as to divide the mold cavity into two sections. The core frame is split into two segments in the thicknesswise direction and has a substantially T-shaped configuration constituted by a vertical portion disposed between the longer frames and projecting downwardly beyond the lower ends of the longer frames and top wing portions projected laterally from the top end of the vertical portion and resting on the upper surfaces of the longer frames. The core frame is detachably secured between the longer frames so that the mold apparatus can be used both in single casting mode with the core frame being demounted and in the twin casting mode with the core frame fixed between the longer sides.

5 Claims, 5 Drawing Figures

MOLD APPARATUS FOR CONTINUOUS CASTING SYSTEM

BACKGROUND OF THE INVENTION

The present invention relates to a mold apparatus for use in a continuous casting system.

It is known to conduct a continuous casting selectively in a single casting mode or a twin casting mode depending on the configuration of the cast product to be obtained.

In this type of casting, a mold for single casting and a mold for twin casting are prepared separately and used selectively as desired, requiring replacement of the molds with each other on the casting line.

It is therefore desirable that casting in both the single casting mode and twin casting mode can be conducted by the same mold. However, the conventional twin mold has bores in the central portions of the longer frame thereof so as to pass a tie rod, as in the case of the shorter walls of the single casting mold, and, as a result of the provision of the bores, the copper sheets which line the inner surface of the longer frames are inevitably split into two portions. Therefore, the frames of the twin casting mold cannot be utilized as the frames of the single casting mold. This inconveniently requires that all the parts such as the frames and copper sheets for longer and shorter frames both for the single and twin cast molds be prepared, resulting in an impractically large number of spare parts.

SUMMARY OF THE INVENTION

Accordingly, an object of the invention is to provide a mold apparatus for a continuous casting system, which is improved to permit common use of various parts such as the copper sheets for longer and shorter frames, as well as the frames themselves, by both the mold for single casting and the mold for twin casting, thereby remarkably reducing the number of spare parts to be prepared.

To this end, according to the invention, there is provided a mold apparatus for use in a continuous casting system, having a pair of parallel longer frames disposed to oppose each other and lined at their opposing surfaces, and a pair of shorter frames disposed between opposing ends of the longer frames and lined at their opposing surfaces, the longer and shorter frames in cooperation defining a rectangular mold cavity, the mold apparatus comprising: a core frame disposed between the longitudinal centers of the longer frames such as to divide the mold cavity into two sections, the core frame being split into two segments in the thicknesswise direction and having a substantially T-shaped configuration constituted by a vertical portion disposed between the longer frames and projecting downwardly beyond the lower ends of the longer frames and top wing portions projected laterally from the top end of the vertical portion and resting on the upper surfaces of the longer frames, the segments of the core frame being lined at their outer surfaces at least the vertical portion; a core frame upper portion locating means disposed on the upper surfaces of the longer frames substantially at the longitudinal centers of the longer frames and adapted for releasably fixing the wing portions of the core frame; a tie rod detachably secured to the lower ends of the segments of the core frame projected downwardly beyond the lower ends of the longer frames, so as to extend parallel with the wing portions of the core frame; a core frame lower portion locating means provided on the undersides of the longer frames substantially at the longitudinal centers of the longer frames and adapted for holding respective ends of the tie rods; upper tightening means for pressing the longer frames to the upper portions of both side edges of the vertical portion of the core frame; and a lower tightening means for pressing the longer frames onto both side edges of the lower portion of the vertical portion of the core frame; whereby the core frame is detachably secured between the longer frames, thereby permitting the mold apparatus to be used selectively either in a single or twin casting mode.

The above and other objects, features and advantages of the invention will become clear from the following description of the preferred embodiment when the same is read in conjunction with the accompanying drawings.

DESCRIPTION OF THE PREFERRED EMBODIMENT

Figure 1:
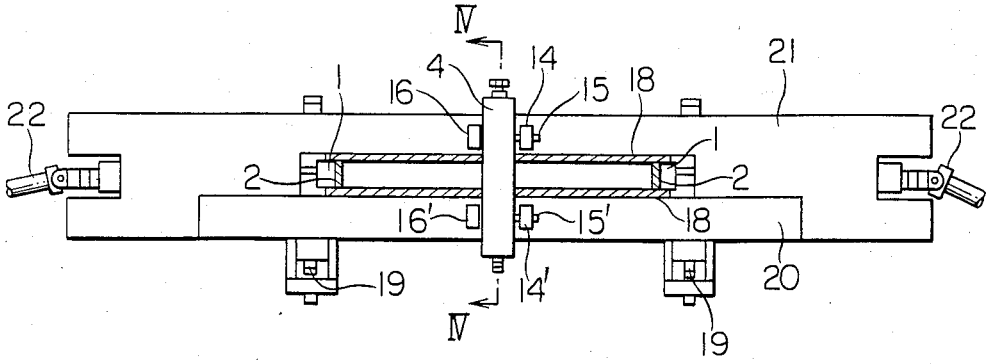
FIG. 1 is a plan view of a mold apparatus of the invention in the state of use for twin casting.
Figure 2:
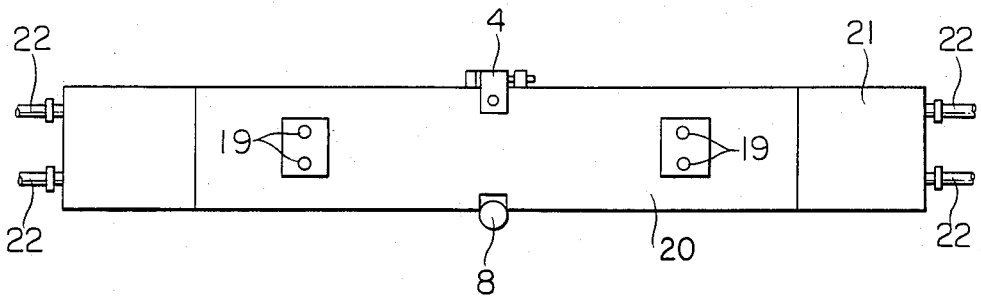
FIG. 2 is a front elevational view of the mold apparatus shown in FIG. 1.
Figure 3:
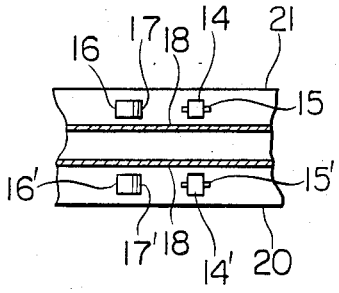
FIG. 3 is an enlarged view of a core locating means of the mold apparatus.

Referring to FIGS. 1 and 2, a mold apparatus in accordance with the invention has a movable longer frame 20 and a stationary longer frame 21 opposing with each other and lined at their inner sides with copper sheets 18, 18. The longer frames 20 and 21 are located and fixed with respect to each other by means of tie rods 19, 19. Shorter copper sheets 2,2 which are secured to the inner sides of shorter frames 1,1 are disposed between the opposing ends of the longer copper sheets 18, 18, thus constituting a mold. The positions of the shorter copper sheets 2,2 are adjustable by means of shorter frame driving devices 22, 22 which are provided on both ends of the stationary longer frame 21. At the longitudinal centers of the stationary longer frame 21 and the movable longer frame 20 are disposed fixed members 14, 14′ with pressing bolts 15, 15′, as well as fixed members 16, 16′ having reference surfaces 17, 17′ opposing the fixed members 14, 14′, as shown in FIG. 3. The fixed members 14, 14′ and the fixed members 16, 16′ in combination constitute a core locating means.

Figure 4:
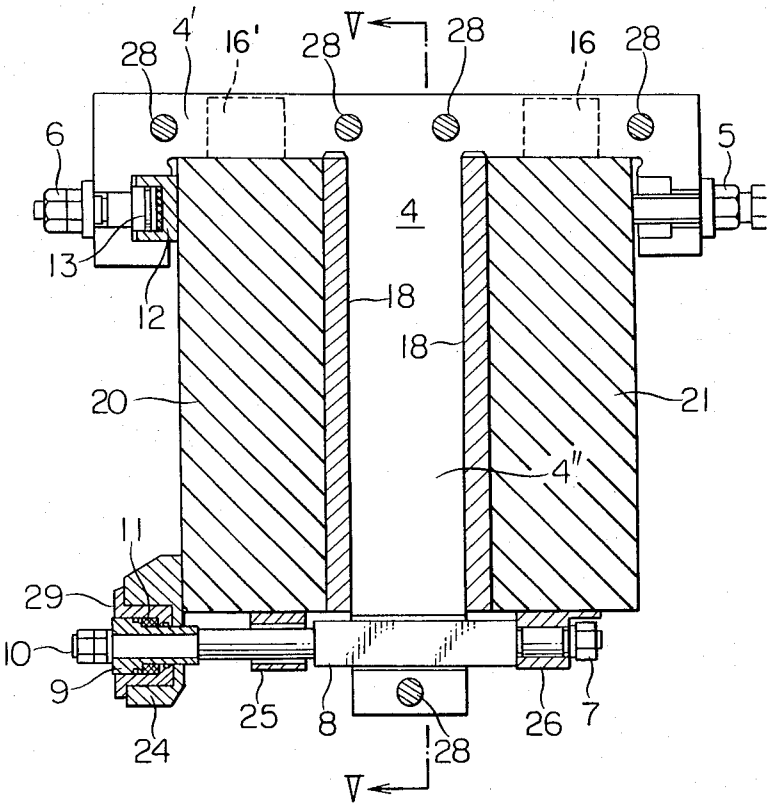
FIG. 4 is a sectional view taken along the line IV—IV of FIG. 1.

Referring now to FIG. 4, brackets 25, 26 are detachably secured by bolts to the undersides of the stationary and movable longer frames 21, 20 substantially at the longitudinal centers of these frames 21, 20. A retaining portion 24 is formed on the underside of the movable longer frame 20 at the widthwise end remote from the stationary longer frame 21.

When the mold apparatus is to be used in the twin casting mode, a substantially T-shaped core frame 4 is placed between the longer frames 20 and 21 such as to divide the space between these longer frames into two sections. More specifically, the core 4 has horizontal top wing portions 4′,4′ which project laterally in left and right directions as viewed in FIG. 4. The top wing portions 4′, 4′ are located by the core locating means 14, 15, 16, 17 on the upper sides of the longer frames 21, 20. A retainer bolt 5 which acts on the outer surface of the stationary longer frame 21 is provided on the outer extremity of one of the wing portions 4', while a retaining bolt 6 connected to the piston of a hydraulic cylinder 12 on the outer surface of the movable longer frame 20 is provided on the outer extremity of the other wing portion 4'.

The core frame 4 also has a vertical portion 4" which is disposed between the longer copper sheets 18 and 18 and projected downwardly beyond the lower end of the longer copper sheets 18, 18 by a predetermined length.

Figure 5:
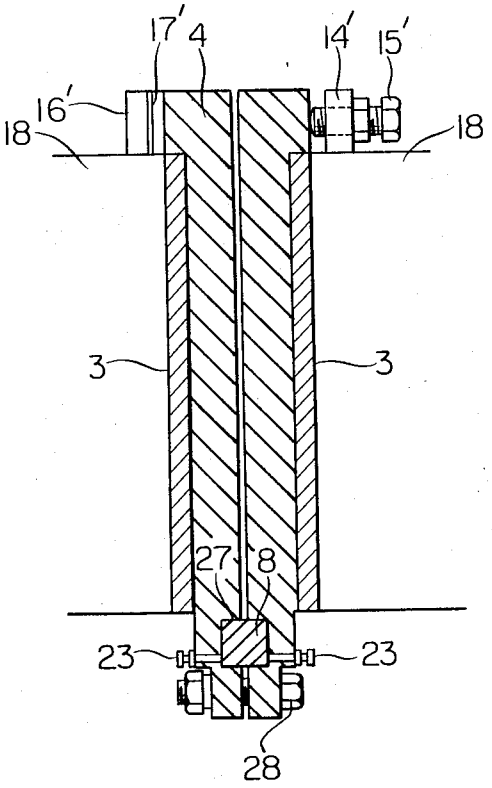
FIG. 5 is a sectional view taken along the line V—V of FIG. 4.

As will be seen from FIG. 5, the core frame 4 has a split-type construction with two segments which are lined at their outer sides with core copper sheets 3,3. The arrangement is such that, when the core frame 4 is set in the manner as illustrated so as to divide the opposing longer copper sheets into two sections, respectively, a twin mold having two molding cavities is formed by the sections of the longer copper sheets 18, 18, the core copper sheets 3,3 and the shorter copper sheets 2,2. A recess 27 of a substantially rectangular cross-section is formed in the lower ends of the opposing surfaces of two segments of the vertical portion 4" of the core frame 4. The recess 27 is adapted for receiving a lower tie rod 8 having a rectangular cross-section and extending in the breadthwise direction of the vertical portion 4". Adjusting screws 23, 23 are screwed into the lower ends of two segments of the vertical portion 4" on both sides of the recess 27. Two segments of the core frame 4 are united with each other by means of coupling bolts 28. More specifically, one coupling bolt 28 is used at the lower end extremities of the vertical portions 4" of two segments, while four coupling bolts are used at the top wing portions 4'. The lower tie rod 8 mentioned before extended at the lower end of the core frame 4 tightens the lower end of the core frame 4 to the lower ends of the stationary and movable longer frames 21, 20. More specifically, the tie rod 8 has a central portion having a rectangular cross-section and both cylindrical end portions having circular cross-sections. The central portion fits in the recess 27 in the lower end of the core frame 4 as explained before. One of the cylindrical ends extends through a bore formed in the bracket 26 and is fixed by a nut 7 screwed thereto, while the other cylindrical end extends through a bore formed in the bracket 25 and is tightened by a nut 10 to a piston 9 which is movable in a hydraulic cylinder 29 engaging with the retaining portion 24.

The piston connected to the bolt 6 on the end of one of the wing portions 4' forms a hydraulic pressure chamber 13 within the associated hydraulic cylinder 12. Similarly, the piston 9 connected to the tie rod 8 forms a hydraulic pressure chamber 11 within the associated hydraulic cylinder 29. The arrangement is such that, as a hydraulic pressure is applied to both hydraulic pressure chambers 11, 13 after tightening of the associated bolts, the copper sheets 18, 18 on the longer frames 20,21 are tightly pressed against both side edges of the vertical portion 4" of the core frame 4.

It will be seen that the described mold apparatus can be used in the single casting mode, simply by demounting the core frame 4. For using the mold apparatus in the twin casting mode, the described parts are assembled in a manner which will be explained hereinunder.

As the first step, the lower tie rod 8 is detached and the core frame 4 with its both segments assembled together by the coupling bolts 28 is inserted into the space between the longer frames 20,21 from the upper side thereof. Subsequently, the coupling bolts 28 are loosened, and the lower tie rod 8 is inserted into the recess 27 in the lower end of the core frame 4 and into the bracket 26 which has been disconnected from the longer frame 21. Then, the bracket 25, which has been disconnected from the longer frame 20, is fitted on the left cylindrical end of the tie rod 8 and, thereafter, the piston 9 of the hydraulic cylinder 29 is fitted on the left cylindrical end of the tie rod 8. Subsequently, after fitting the hydraulic cylinder 29 in the bore formed in the retaining portion 24, the brackets 25 and 26 are secured by bolts to the undersides of respective longer frames 20 and 21, and the coupling bolts 28 are tightened again to fix the split type core frame to the rectangular central portion of the lower tie rod 8.

Then, the bolts 15, 15' engaging with the fixed members 14, 14' are tightened to press the core frame 4 onto the reference surfaces 17, 17' of the fixed members 16, 16', thereby centering the core frame 4, followed by tightening of the bolts 5,6 thereby fixing the core frame 4 to the longer frames 20, 21.

Then, the nuts 7 and 10 are rotated to fix the lower tie rod 8 to the longer frames 20, 21, and the adjusting bolts 23, 23 are driven to act on the lower tie rod 8, thereby properly locating the lower end of the core frame 4.

Finally, a pressurized oil is introduced into the hydraulic chambers 11 and 13, thereby exerting a predetermined force on the core frame 4, thus fixing the core frame 4. In this state, the space between two longer frames 20, 21 are divided into two equal sections, so that the mold apparatus is ready for use in the twin casting mode operation.

In a modification of the described embodiment, if a large space is permitted for installation of more cylinders, the chambers 11, 13 accommodate disc-like springs which act to tighten the longer frames 20, 21 onto the core frame 4. In such a case, another hydraulic cylinder is used for the purpose of moving the movable longer frame 20 against the disc-like springs, thereby effecting removal of the core frame from the longer frames 20, 21.

When it is desired to adjust the positions of the shorter frames 1,1, the shorter frames 1,1 and the longer frames 20,21 can be released from each other even with the lower tie rod 8 fixed to the longer frames 20,21, by draining the hydraulic chambers 11, 13. In the case of the modification explained above, this can be achieved by activating the hydraulic cylinder. In this state, the positions of the shorter sides 1,1 can be adjusted freely by the operation of the shorter side driving devices 22,22.

The mold apparatus of the invention for continuous casting system, which is constructed as explained hereinbefore, offers the following advantages.

Namely, the employment of the core mold for the twin casting mode permits the use of various parts such as the longer and shorter copper sheets and frames commonly both in the single casting mode and twin casting mode, so that the number of spare parts which are to be prepared for the operation of the continuous casting system can be reduced remarkably.

What is claimed is:

1. A mold apparatus for use in a continuous casting system, having a pair of parallel longer frames disposed to oppose each other and lined at their opposing surfaces, and a pair of shorter frames disposed between opposing ends of said longer frames and lined at their opposing surfaces, said longer and shorter frames in cooperation defining a rectangular mold cavity, said mold apparatus comprising: a core frame disposed between the longitudinal centers of said longer frames such as to divide said mold cavity into two sections, said core frame being split into two segments in the thicknesswise direction and having a substantially T-shaped configuration constituted by a vertical portion disposed between said longer frames and projecting downwardly beyond the lower ends of said longer frames and top wing portions projected laterally from the top end of said vertical portion and resting on the upper surfaces of said longer frames, said segments of said core frame being lined at their outer surfaces at at least said vertical portion; a core frame upper portion locating means disposed on the upper surfaces of said longer frames substantially at the longitudinal centers of said longer frames and adapted for releasably fixing said wing portions of said core frame; a tie rod detachably secured to the lower ends of said segments of said core frame projected downwardly beyond the lower ends of said longer frames, so as to extend parallel with said wing portions of said core frame; a core frame lower portion locating means provided on the undersides of said longer frames substantially at the longitudinal centers of said longer frames and adapted for holding respective ends of said tie rod; upper tightening means for pressing said longer frames to the upper portions of both side edges of said vertical portion of said core frame; and a lower tightening means for pressing said longer frames onto both side edges of the lower portion of said vertical portion of said core frame; whereby said core frame is detachably secured between said longer frames, thereby permitting said mold apparatus to be used selectively either in a single or twin casting mode.

2. A mold apparatus according to claim 1, wherein said tie rod has a rectangular cross-section at at least the central portion thereof which is complementary to a rectangular cross-section of a recess formed in the lower portion of said vertical portion of said core frame so as to receive said tie rod, said mold apparatus further comprising a coupling bolt extending through the lower end extremities of said segments of said core frame so as to tighten said segments onto said tie rod.

3. A mold apparatus according to claim 2, wherein said core frame lower portion locating means includes a first bracket detachably secured to the underside of one of said longer frames and having a bore for receiving one end of said tie rod, and a second bracket detachably secured to the underside of the other longer frame and having a bore for receiving the other end of said tie rod; while said lower tightening means includes a nut which is in screwing engagement with one end of said tie rod and adapted to tighten said one end to said first bracket, and a hydraulic cylinder provided on said other longer frame and slidably receiving a piston connected to the other end of said tie rod.

4. A mold apparatus according to any one of the preceding claims, wherein said upper tightening means includes a retaining bolt provided on the end extremity of one of said wing portions of said core frame and acting at its end on the outer surface of one of said longer frames, and a hydraulic cylinder provided on the outer surface of the other longer frame and slidably receiving a piston which is secured to the end extremity of the other wing portion of said core frame.

5. A mold apparatus according to claim 1, wherein said longer frames, shorter frames and said segments of said core frame are lined with copper sheets.

* * * * *